United States Patent [19]

Smith

[11] Patent Number: 4,732,277

[45] Date of Patent: Mar. 22, 1988

[54] TONER CARTRIDGE WITH REMOVABLE SLEEVE CLOSURE

[75] Inventor: Wayne R. Smith, Pittsford, N.Y.

[73] Assignee: Xerox Corporation, Stamford, Conn.

[21] Appl. No.: 4,936

[22] Filed: Jan. 20, 1987

[51] Int. Cl.[4] ..... B65D 83/06

[52] U.S. Cl. ..... 206/633; 206/216; 222/505; 222/542; 222/DIG. 1; 355/3 R

[58] Field of Search ..... 206/631, 633, 216; 222/DIG. 1, 542, 505, 541, 544; 355/3 R, 3 DD, 14 R, 8; 220/359

[56] References Cited

U.S. PATENT DOCUMENTS

| | | | |
|---|---|---|---|
| 2,904,000 | 9/1959 | Fisher et al. | 118/657 |
| 3,339,807 | 9/1967 | Eichorn | 222/171 |
| 3,385,500 | 5/1968 | Lavander | 229/7 |
| 3,618,826 | 11/1971 | Kangas | 206/633 X |
| 3,999,654 | 12/1976 | Pollack | 206/216 |
| 4,062,385 | 12/1977 | Katusha et al. | 141/89 |
| 4,441,636 | 4/1984 | Yamashita et al. | 222/541 |
| 4,478,512 | 10/1984 | Zoltner | 206/633 X |
| 4,491,161 | 1/1985 | Tamura et al. | 222/DIG. 1 |
| 4,573,614 | 3/1986 | Ozawa | 222/542 |
| 4,614,286 | 9/1986 | Yamaguchi et al. | 222/DIG. 1 |
| 4,650,070 | 3/1987 | Oka et al. | 206/633 X |

FOREIGN PATENT DOCUMENTS

| | | |
|---|---|---|
| 56-21166 | 2/1981 | Japan . |
| 59-53868 | 3/1984 | Japan . |

*Primary Examiner*—Stephen Marcus
*Assistant Examiner*—Bryon Gehman

[57] ABSTRACT

A toner cartridge for use in a copying machine for supplying fresh toner to the developer for the machine is disclosed as being formed with an elongated opening to permit discharge of toner when inverted. A removable flexible strip covers the opening and is detachably held to the cartridge by adhesive material. The strip comprises a flattened sleeve having the edges of one of its sides adhesively held onto the cartridge across the opening and a pulling member retained in the sleeve with one of its ends connected to one end of the sleeve so that a gradual pulling of the other end of the member progressively removes the sleeve as the same is turned within itself or inside out thereby carrying toner particles adhering to the sleeve within the sleeve.

1 Claim, 5 Drawing Figures

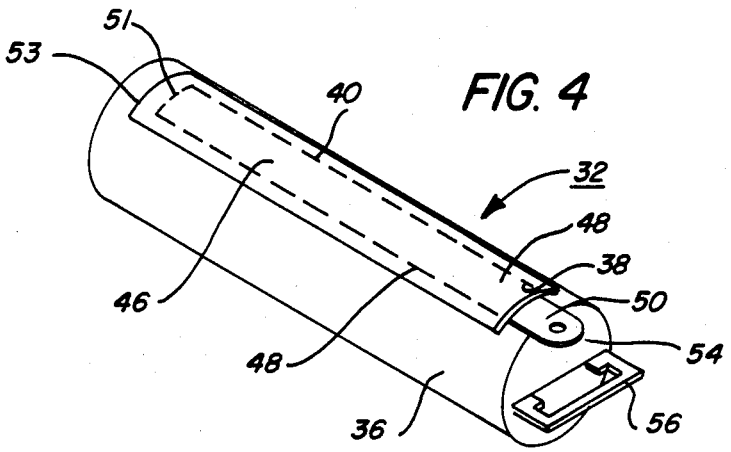
FIG. 4
FIG. 5
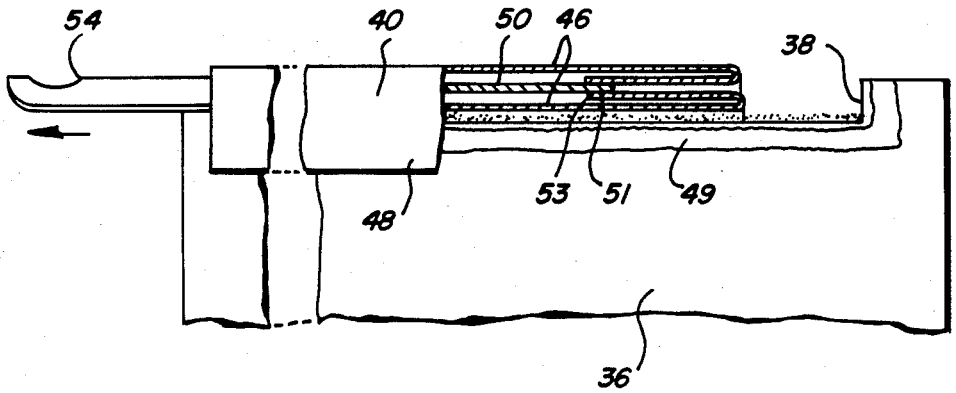

TONER CARTRIDGE WITH REMOVABLE SLEEVE CLOSURE

This invention relates generally to an electrophotographic printing machine, and more particularly concerns a toner cartridge for discharging additional toner particles into the toner dispenser of the development system used in the printing machine.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photocoductive member corresponding to the informational areas contained within the original document. After recording the electrostatic latent image on the photoconductive member, the latent image is developed by bringing a developer material into contact therewith. Generally, the developer material comprises toner particles adhering triboelectrically to carrier granules. The toner particles are attracted to the latent image from the carrier granules to form a powder image on the photoconductive member which is subsequently transferred to a copy sheet. Finally, the copy sheet is heated to permanently affix the powder image thereto in image configuration.

As the toner particles are depleted from the developer material, it is necessary to dispense additional toner particles into the developer mixture. In this way, the concentration of toner particles within the developer mixture is maintained substantially constant. To achieve this, electrophotographic printing machines frequently have dispensers which discharge toner particles into the development system. After a period of time, it is necessary to replenish the toner particles within the dispenser. When adding additional toner particles to the dispenser in the printing machine, any spillage results in contamination of the areas having the spilled toner particles thereon. The toner particles, being very finely ground, also become airborne carrying this contamination to other areas not immediately adjacent the development system. Furthermore, the spilled toner particles also have a tendency to cling to the operator's hands or to the surrounding environment. It is thus clear that the addition of toner particles into the printing machine is a dirty and messy job which frequently inadvertently spills on the operator's hands and clothing. It is, therefore, highly desirable to package the toner particles in a manner such that the contamination of both the operator and the printing machine is minimized.

Various approaches have been devised to improve toner cartridges used to furnish additional toner particles to the dispenser of the development system used in an electrophotographic printing machine.

In U.S. Pat. No. 2,904,000, Fisher et al discloses a toner magazine having a container consisting of an elongated, generally rectangular plastic box with the bottom wall thereof having a number of apertures therein. During storage and prior to actual use, the apertures are covered by a strip of plastic tape. The tape is removed just before the container is inserted for use in the magazine.

In U.S. Pat. No. 3,339,807, Eichorn describes a toner package having a cylindrical body with several openings therein. The openings are sealed by a tear strip or cover with a tab which is easily removable by hand before insertion into the dispensing apparatus of the printing machine. Toner particules are discharged from the toner package through the openings therein.

In U.S. Pat. No. 3,385,500, Lavander discloses a toner package consisting of a rectangular cardboard body. The bottom portion of the container defines a removable tear strip which extends along the bottom of the container. The strip includes a tab portion which extends beyond the length of the toner package. The tab portion has an opening therein which is gripped by a protruding portion of a slide. The toner package and the slide are then both placed into the toner dispenser along guide rails. The slide is then removed pulling the bottom strip from the toner package. This discharges the toner particles into the toner dispenser.

In U.S. Pat. No. 4,478,512, Zoltner discloses a toner cartridge having a tubular container formed with an elongated opening. Held onto the container and closing the opening is a removable sealing strip which is removed as the same is clipped into a toner dispenser by the operator.

U.S. Pat. No. 4,062,385 discloses a toner container having a sealing tear strip which is manually removed to uncover an opening in the container and permit dripping of toner into a hopper for use in a copier. As the tear strip is removed, it folds upon itself, and toner adhering to one of its sides is removed by means of a pliable wiper seal. The system is relatively complex, comprises too many parts and would be too costly for throw-away containers.

U.S. Pat. No. 3,999,654 discloses a toner container which includes a sealing strip adhesively held on the container over a toner dispensing opening and which may be manually pulled for removal. As the strip is removed, it folds upon itself. No concern or provision is made for self-cleaning toner from the strip or otherwise prevent toner from becoming loose in the atmosphere.

Japanese Pat. No. 59-53868 also discloses a sealing strip for a toner cartridge which folds upon itself as it is removed. There is no provision for preventing toner from adhering to the strip and avoid its exposure to the atmosphere.

Japanese Pat. No. 56-21166 discloses a toner cartridge having a sealing strip attached to guide members which, when removed, effects the stripping of the sealing strip from the cartridge to allow toner to exit therefrom.

In accordance with the present invention, there is provided an apparatus for storing a supply of marking particles therein. A cartridge defines a chamber for storing the marking particles, such as toner, therein. The cartridge has an elongated opening in the surface thereof for the discharge of the marking particles therefrom. A flexible, flattened sealing sleeve is removably secured to the container sealing the opening in the surface thereof to prevent the discharge of the marking particles therefrom. The flexible sleeve is applied as by adhesive material over the entire opening and beyond all edges thereof. A flexible pull strip is positioned within and along the length of the sleeve, being secured at one end of the sleeve and extending beyond the other end of the sleeve to define a manual pulling handle. Pulling on the handle by the operator produces sliding action of the strip within the sleeve which causes the sleeve to peel from the opening starting at one end of the cartridge and to cause the sleeve to turn itself inside out as the sleeve is continuously stripped from the opening.

Other apsects of the present invention will become apparent as the following description proceeds and upon reference to the drawings, in which:

FIG. 4 is an isometric view illustrating the toner cartridge used in the FIG. 3 toner dispenser system; and FIG. 5 is an enlarged view of a portion of the cartridge, with parts broken away, showing the removal of a sealing strip.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
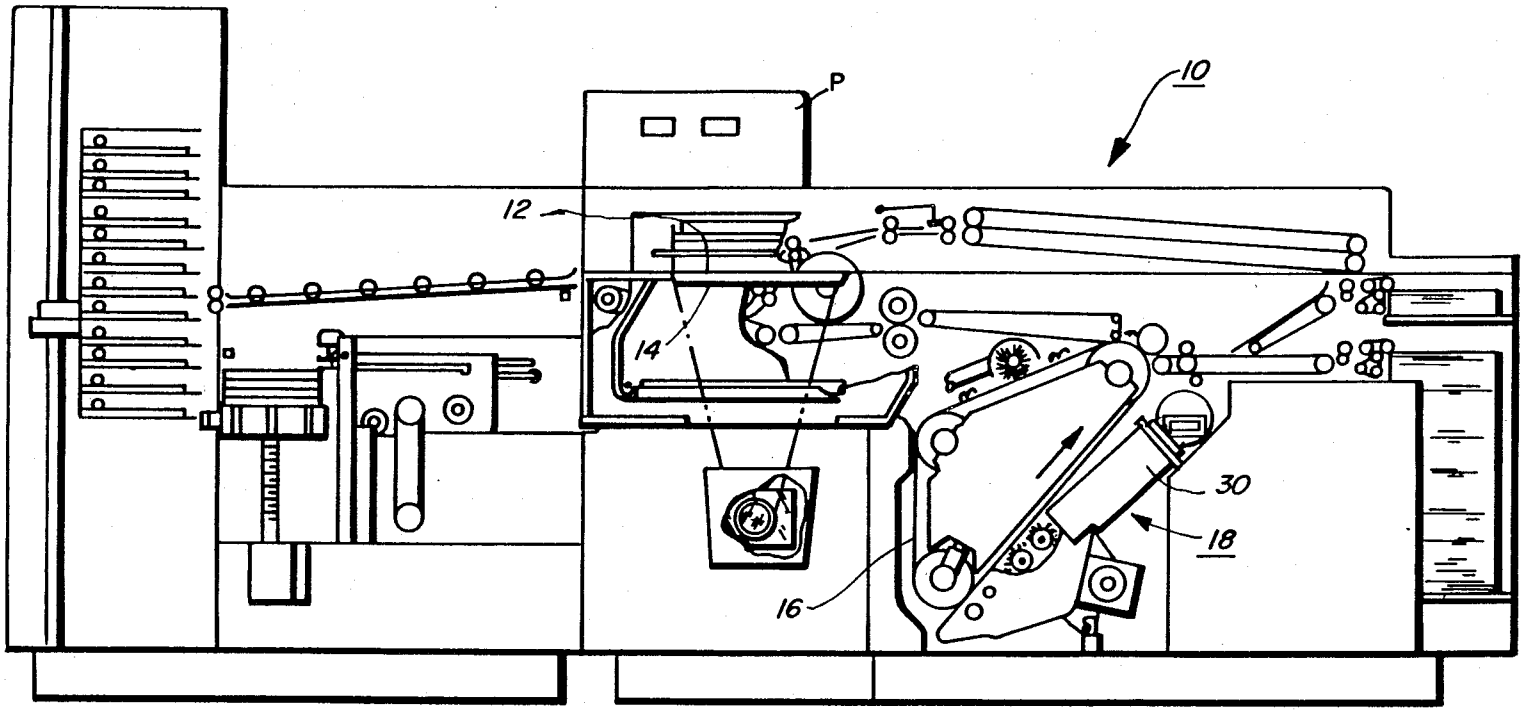
FIG. 1 is a schematic elevational view of an electrophotographic printing machine incorporating the features of the present invention therein.
Figure 2:
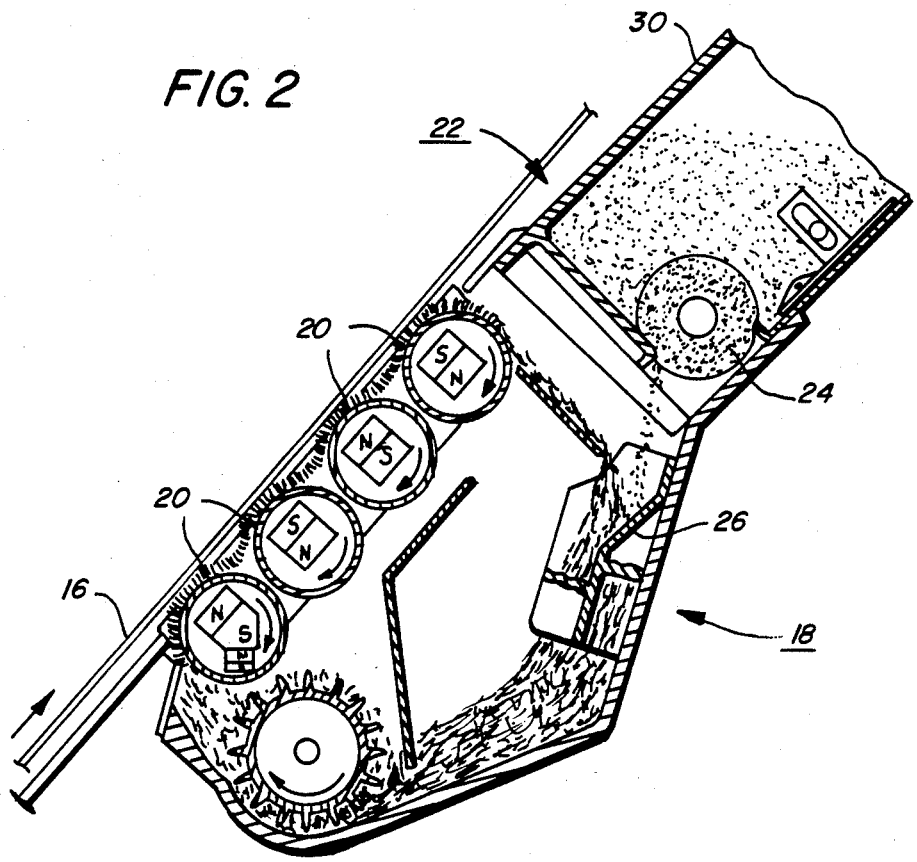
FIG. 2 is an elevational view showing the development system used in the FIG. 1 printing machine.

For a general understanding of an electrostatic processing system in which the invention may be incorporated, reference is made to FIG. 1. As in all electrostatic reproduction machines of the type illustrated, a light image of an original to be reproduced is projected onto the sensitized surface of a xerographic plate to form an electrostatic latent image thereon. Thereafter, the latent image is developed with an oppositely charged developing material comprising carrier beads and smaller toner particles triboelectrically adhering thereto to form a xerographic powder image corresponding to the latent image of the plate surface. The powder image is then electrostatically transferred to a support surface to which it may be fixed by a fusing device whereby the toner image is caused permanently to adhere to the support surface.

In the illustrated machine 10, an original 12 to be copied is placed upon a transparent support platen 14 fixedly arranged in an exposing illumination assembly. While upon the platen, an illumination system flashes light rays upon the original, thereby producing image rays corresponding to the informational areas on the original. The image rays are projected by means of an optical system to an exposure station for exposing the previously charged photosensitive surface of a moving xerographic plate in the form of a flexible photoconductive belt 16.

The exposure of the belt surface to the light image produces a latent electrostatic image on the moving belt in image configuration corresponding to the light image projected from the origianl on the supporting platen. The belt surface continues its movement through a developing apparatus or developer generally indicated by the reference numeral 18. The developing apparatus 18 comprises a plurality of magnetic brushes 20 which carry developing material to the adjacent surface of the upwardly moving inclined photoconductive belt 16. As the developing material is applied to the xerographic belt, toner particles in the development material are attracted electrostatically to the belt surface to form powder images. During the reproduction process, toner is periodically automatically dispensed into the conventional means such as a foam roller 24. Further details of the developer 18 are not necessary to understand and implement the present invention. Details of such a developing apparatus are adequately disclosed in U.S. Pat. No. 3,724,422, which is incorporated by reference herein. Further description of the machine 10 and the xerographic process is unnecessary since these are well known in the art.

The developer apparatus includes a cross-mixing baffle 26 which mixes the fresh toner particles being discharged from dispenser 22 with the denuded carrier granules and unused developed material being returned to the chamber within the developing apparatus. The dispenser 22 includes a housing 30 for receiving a toner cartridge, indicated generally by the reference numeral 32. The foam roller 24 is disposed in the opening of the housing 30 to dispense toner particles therefrom.

In operation, toner cartridge 32 is inserted into housing 30 of the toner dispenser 22 and the roller 24 dispenses toner particles from housing 30 onto the mixing device 26. The device 26 mixes the freshly dispensed toner particles with the denuded carrier granules and unused developer material, and this mixture is then returned to the housing for the developer 18.

Figure 3:
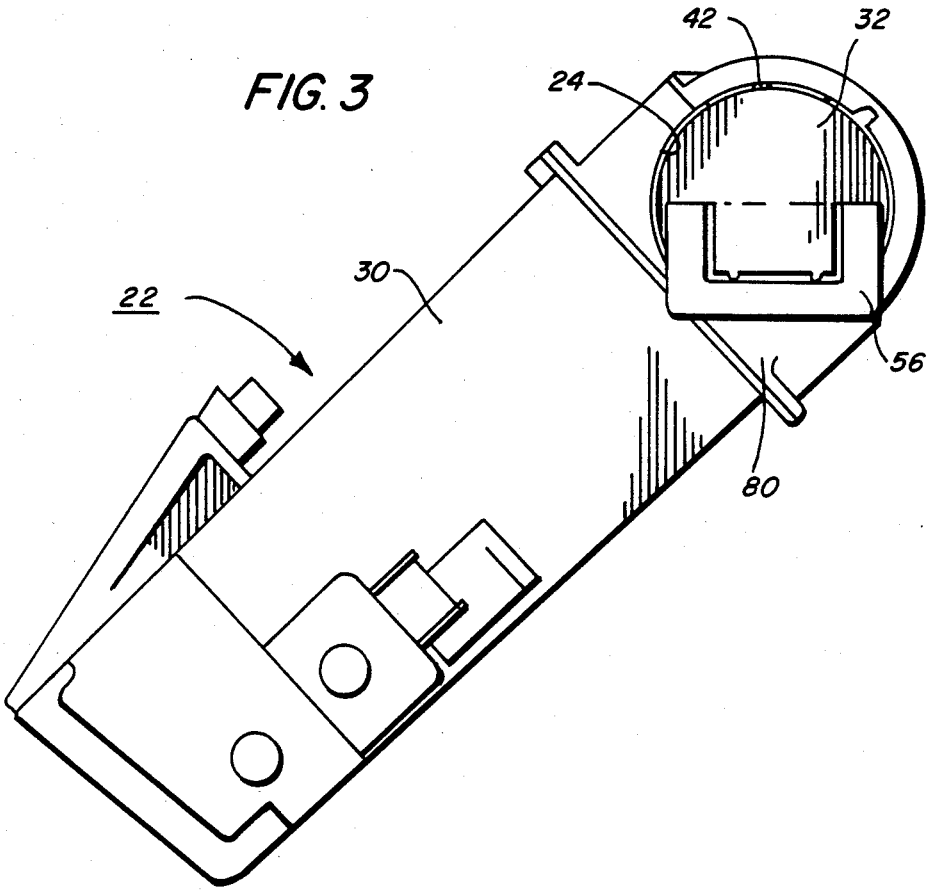
FIG. 3 is an elevational view of the toner dispenser to which the present invention is associated.

As shown in FIG. 3, the toner cartridge 32 is positioned with an opening 34 in the upper end of the dispenser 22 so as to be in communication with housing 30 for the discharge of the toner particles thereto. The toner cartridge 32 includes a container 36 having an opening 38 therein. The container 36 is tubular and defines an interior chamber for storing the toner particles therein. A flexible sealing strip 40 is adhesively secured to the container 36 over the opening 38 and has an adhesive coating on the edge surfaces thereof in contact with the container 36 adjacent the edges of the opening 38.

A key 42 is integral with and extends upwardly from the container 36, and when the toner cartridge 32 is inserted into the housing 30, the key 42 mates with a slot therein preventing the rotary movement thereof.

As shown in FIG. 4, the toner container 36 has the opening 38 therein sealed with sealing strip 40. After the cartridge 36 has been inserted into the housing 30 with the opening 38 facing upwardly, and the strip 40 has been removed, as will be described below, the cartridge is rotated 180°. This rotation, when completed, places the opening facing downwardly so that the chamber within the cartridge is in communication with the interior of the housing 30. In this latter position, toner particles are discharged by gravity from the chamber through the opening 38 and into the dispenser 22.

The container 36 may be made out of any suitable material, such as plastic material, derived from the blow mold process. This form of manufacture results in a single structural piece, with all parts made singularly from the same material. On the other hand, the body of the container may be made from paper in tube form and with end caps made of metal. The sleeve 46 of the strip 40 is preferably made of polyethelene material.

As shown in FIGS. 4 and 5, the sealing strip 40 comprises a flat, flexible sleeve 46 having edge portions 48 which overlap and are detachably mounted on the container 36 by the use of adhesive magerial 49 applied to the contacting edge portions 48. A flexible, elongated pulling member 50 is positioned within the sleeve 46 and has one end 51 bonded to adjacent end 52 of the sleeve 46 internally thereof. The other end 53 of the pulling member extends out of the sleeve at the other end thereof and terminates in a manually activating tab 54.

In its assembly upon the container 36, the sleeve is arranged so that the manual tab 54 extends beyond the adjacent end of the container so that when the cartridge is positioned within the opening 34 of the toner dispenser 30, the tab will protrude out of the dispenser housing. A suitable flexible handle 56 is hingeably mounted at the same end of the cartridge 32 to which the strip 40 is applied to permit the installation, removal and rotation of the cartridge.

In operation, after the cartridge is inserted into the opening 34, the operator slowly commences pulling the tab 54 outwardly. This action initiates the pulling of the end 53 of the sleeve 46 inwardly within itself thereby causing the uncovering of the adjacent end of the opening 38. Continual pulling of the tab 54 with consequent movement of the member 50 within and relative to the sleeve 46 continues to draw the end 53 of the sleeve within itself thereby turning the sleeve inside out and causing the sleeve to be peeled away from the opening 38. Toner partcles within the chamber of the container 36 which adhere to the side of the sleeve 46 facing the interior of the cmaber are also drawn within the sleeve as it is turned inside out. In this manner, toner particles which would normally escape as a sealing strip is removed are captured, thereby rendering the foregoing operation a clean procedure for the replenishing of toner in a developing apparatus.

During the removal of the sealing strip 40 by the turning of itself inside out, the member 50 and flattened sleeve 40 are drawn out of the circumferential spacing between the cartridge 32 and the opening 34 within the housing 30. Complete removal of the sealing strip and uncovering of the opening 38 are made while the cartridge is contained within the housing 30. Therefore, the clean-hands and atmosphere procedure is maintained throughout the entire replenishing of toner particles from the cartridge. After the strip 40 is removed, the operator need only rotate the cartridge to effect the removal of toner particles.

While the invention has been described to the structure disclosed, it is not confined to the details set forth, but is intended to cover such modifications or changes as may come within the scope of the following claims.

I claim:

1. An apparatus for storing a supply of marking particles therein, including:

a container defining a chamber for storing the marking particles therein and having an elongated opening in the wall thereof extending substantially the length of said container for the discharge of the marking particles therefrom;

a flexible sealing strip removably secured to said container sealing said opening to prevent the discharge of the marking particles therefrom, said sealing strip having a flat sleeve extending across said opening and beyond the edges thereof, a layer of adhesive material applied between those portions of the container adjacent the edges of said opening and the adjacent surface of said sleeve, and an elongated pulling member within said sleeve and being connected at one end to one end of said sleeve so that a gradual pulling motion at the other end of the member will effect the gradual stripping of said sleeve from said container and the turning inside out of said sleeve.

* * * * *